US009273835B2

(12) United States Patent
Negley et al.

(10) Patent No.: US 9,273,835 B2
(45) Date of Patent: Mar. 1, 2016

(54) LINEAR LED LAMP

(71) Applicant: Cree, Inc., Durham, NC (US)

(72) Inventors: Gerald H. Negley, Chapel Hill, NC (US); Antony Paul van de Ven, Hong Kong (CN); Paul Kenneth Pickard, Morrisville, NC (US)

(73) Assignee: Cree, Inc., Durham, NC (US)

( * ) Notice: Subject to any disclaimer, the term of this patent is extended or adjusted under 35 U.S.C. 154(b) by 0 days.

(21) Appl. No.: 14/055,052

(22) Filed: Oct. 16, 2013

(65) Prior Publication Data

US 2014/0043804 A1 Feb. 13, 2014

Related U.S. Application Data

(63) Continuation of application No. 12/962,847, filed on Dec. 8, 2010, now Pat. No. 8,587,185.

(51) Int. Cl.

| | |
|---|---|
| ***F21K 99/00*** | (2010.01) |
| *F21Y 101/02* | (2006.01) |
| *F21Y 103/00* | (2006.01) |

(52) U.S. Cl.

CPC ... *F21K 9/54* (2013.01); *F21K 9/17* (2013.01); *F21K 9/50* (2013.01); *F21Y 2101/02* (2013.01); *F21Y 2103/003* (2013.01); *Y10T 29/49002* (2015.01)

(58) Field of Classification Search

CPC ..... H01L 33/54
USPC ..... 313/46, 502–512, 22; 362/101
See application file for complete search history.

(56) References Cited

U.S. PATENT DOCUMENTS

| | | | |
|---|---|---|---|
| 5,463,280 | A | 10/1995 | Johnson |
| 5,585,783 | A | 12/1996 | Hall |
| 5,655,830 | A | 8/1997 | Ruskouski |

(Continued)

FOREIGN PATENT DOCUMENTS

| | | | |
|---|---|---|---|
| CN | 101655189 | A | 2/2010 |
| EP | 1058221 | A2 | 12/2000 |

(Continued)

OTHER PUBLICATIONS

Liquileds, Liquid LED, http://www.liquidleds.com.tw/, Sep. 28, 2010, 1 page.

(Continued)

*Primary Examiner* — Anne Hines
(74) *Attorney, Agent, or Firm* — Steven B. Phillips; Moore & Van Allen PLLC

(57) ABSTRACT

A linear LED lamp is disclosed. Embodiments of the invention can provide an LED-based replacement lamp for a linear or "tube-type" bulb or a bulb with a linear filament or element. By filling the void within the lamp with an optically transmissive fluid to cool the LEDs without the use of a traditional heat sink, the light blocking effects of such a heat sink can be avoided. Thus, the LED replacement lamp can emit light in a substantially omnidirectional pattern. In some embodiments, the optically transmissive fluid medium is a liquid. In some embodiments, the optically transmissive fluid medium is a gel. An index matching medium can be used as the optically transmissive fluid medium. A color mixing treatment can optionally be included to eliminate color tints in cases where multiple LEDs of different colors are used to produce white light.

20 Claims, 4 Drawing Sheets

(56) References Cited

U.S. PATENT DOCUMENTS

| | | | | |
|---|---|---|---|---|
| 5,688,042 | A | 11/1997 | Madadi et al. | |
| 5,947,588 | A | 9/1999 | Huang | |
| 5,949,347 | A | 9/1999 | Wu | |
| 5,952,916 | A | 9/1999 | Yamabe | |
| 6,220,722 | B1 | 4/2001 | Begemann | |
| 6,276,822 | B1 | 8/2001 | Bedrosian et al. | |
| 6,452,217 | B1 | 9/2002 | Wojnarowski et al. | |
| 6,465,961 | B1 | 10/2002 | Cao | |
| 6,634,770 | B2 | 10/2003 | Cao | |
| 6,635,987 | B1 | 10/2003 | Wojnarowski et al. | |
| 6,639,360 | B2 | 10/2003 | Roberts et al. | |
| 6,746,885 | B2 | 6/2004 | Cao | |
| 6,853,151 | B2 | 2/2005 | Leong et al. | |
| 6,860,628 | B2 | 3/2005 | Robertson et al. | |
| 6,936,968 | B2 | 8/2005 | Cross et al. | |
| 7,048,410 | B2 | 5/2006 | Kutler | |
| 7,049,761 | B2 | 5/2006 | Timmermans et al. | |
| 7,114,830 | B2 | 10/2006 | Robertson et al. | |
| 7,307,391 | B2 | 12/2007 | Shan | |
| 7,510,299 | B2 | 3/2009 | Timmermans et al. | |
| 7,520,628 | B1 * | 4/2009 | Sloan et al. | 362/101 |
| 7,815,338 | B2 | 10/2010 | Siemiet et al. | |
| 7,926,975 | B2 | 4/2011 | Siemiet et al. | |
| 7,976,196 | B2 | 7/2011 | Ivey et al. | |
| 8,058,659 | B2 | 11/2011 | Bisberg | |
| 8,093,823 | B1 | 1/2012 | Ivey et al. | |
| 8,115,411 | B2 | 2/2012 | Shan | |
| 8,118,447 | B2 | 2/2012 | Simon et al. | |
| 8,247,985 | B2 | 8/2012 | Timmermans et al. | |
| 8,282,247 | B2 | 10/2012 | Ivey et al. | |
| 8,324,817 | B2 | 12/2012 | Ivey et al. | |
| 8,360,599 | B2 | 1/2013 | Ivey et al. | |
| 8,362,710 | B2 | 1/2013 | Langovsky | |
| 8,382,327 | B2 | 2/2013 | Timmermans et al. | |
| 8,398,258 | B1 * | 3/2013 | Gerrish et al. | 362/183 |
| 8,419,223 | B2 | 4/2013 | Withers | |
| 8,421,366 | B2 | 4/2013 | Palazzolo et al. | |
| 8,449,137 | B2 | 5/2013 | Dassanayake et al. | |
| 8,482,212 | B1 | 7/2013 | Ivey et al. | |
| 8,573,813 | B2 | 11/2013 | Ivey et al. | |
| 8,596,813 | B2 | 12/2013 | Ivey | |
| 8,698,171 | B2 * | 4/2014 | Yuan et al. | 257/89 |
| 2002/0060526 | A1 | 5/2002 | Timmermans et al. | |
| 2004/0007980 | A1 * | 1/2004 | Shibata | 313/634 |
| 2004/0201990 | A1 | 10/2004 | Meyer | |
| 2009/0140271 | A1 * | 6/2009 | Sah | 257/88 |
| 2009/0184618 | A1 | 7/2009 | Hakata et al. | |
| 2012/0040585 | A1 | 2/2012 | Huang | |
| 2012/0051041 | A1 | 3/2012 | Edmond et al. | |

FOREIGN PATENT DOCUMENTS

| | | | |
|---|---|---|---|
| EP | 1475846 | A2 | 11/2004 |
| GB | 2345954 | A | 7/2000 |
| JP | H08162677 | A | 6/1996 |
| JP | H09265807 | A | 10/1997 |
| JP | 2000173304 | A | 6/2000 |
| JP | 2001118403 | A | 4/2001 |
| JP | 2007059930 | A | 3/2007 |
| JP | 2008288183 | A | 11/2008 |
| JP | 2009117346 | A | 5/2009 |
| JP | 3153766 | U | 9/2009 |
| JP | 2009277586 | A | 11/2009 |
| WO | 9833007 | | 7/1998 |
| WO | 0124583 | A1 | 4/2001 |
| WO | 0160119 | A2 | 8/2001 |
| WO | 2004100213 | A2 | 11/2004 |
| WO | 2010099755 | A1 | 9/2010 |
| WO | 2012011279 | A1 | 1/2012 |
| WO | 2012031533 | A1 | 3/2012 |

OTHER PUBLICATIONS

Cree, Inc., International Application No. PCT/US2011/062795, International Search Report and Written Opinion, Jun. 1, 2012.
U.S. Appl. No. 13/943,376, filed Jul. 16, 2013.
U.S. Appl. No. 13/943,455, filed Jul. 16, 2013.
U.S. Appl. No. 14/103,063, filed Dec. 11, 2013.
U.S. Appl. No. 14/224,501, filed Mar. 25, 2014.
U.S. Appl. No. 13/772,436, filed Feb. 21, 2013.
U.S. Appl. No. 29/467,949, filed Sep. 25, 2013.
U.S. Appl. No. 13/943,152, filed Jul. 16, 2013.

* cited by examiner

LINEAR LED LAMP

CROSS REFERENCES TO RELATED APPLICATION

This application is a continuation application of and claims priority from U.S. application Ser. No. 12/962,847, filed Dec. 8, 2010, the entire disclosure of which is hereby incorporated by reference.

BACKGROUND

Light emitting diode (LED) lighting systems are becoming more prevalent as replacements for existing lighting systems. LEDs are an example of solid state lighting and have advantages over traditional lighting solutions such as incandescent and fluorescent lighting because they use less energy, are more durable, operate longer, can be combined in red-blue-green arrays that can be controlled to deliver virtually any color light, and contain no lead or mercury.

In many applications, one or more LED dies (or chips) are mounted within an LED package or on an LED module, which may make up part of a lighting unit, light bulb, or more simply a "lamp," which may also include one or more power supplies to power the LEDs. Some units include multiple LED modules. A module or strip of a lamp includes a packaging material with metal leads (to the LED dies from outside circuits), a protective housing for the LED dies, a heat sink, or a combination of leads, housing and heat sink.

An LED lamp may be made with a form factor that allows it to replace a standard threaded incandescent bulb, or any of various types of fluorescent lamps. LED fixtures and lamps often include some type of optical elements external to the LED modules themselves. Such optical elements may allow for localized mixing of colors, collimate light, and provide the minimum beam angle possible.

In the case of an LED lamp designed to replace a tubular fixture, such as a standard fluorescent "tube" type bulb, the heat sink for the strip of LEDs inside the envelope of the bulb typically blocks light in one direction. However, if the bulb is positioned so that the heat sink is oriented up, towards the top, inside or back of the fixture and the LEDs face outward or down, such an LED lamp can be a viable replacement for a fluorescent tube.

SUMMARY

Embodiments of the present invention can provide an improved LED-based replacement lamp for a linear or "tube-type" bulb that would normally emit light in all directions around the tube. By filling the void within the lamp with an optically transmissive fluid to cool the LEDs without the use of a traditional heat sink, the light blocking effects of such a heat sink can be avoided. Thus, the LED replacement lamp can emit light in an omnidirectional pattern, making it a more natural replacement for a tube type bulb.

It should be noted that while tube-type fluorescent bulbs are given as an illustrative example of the type of lamp that could be replaced by an embodiment of the invention, any elongated type of bulb or bulb with an elongated filament or light producing element could be replaced with an LED lamp like that described herein. Other examples of bulbs that could be replaced by an embodiment of the invention include incandescent aquarium bulbs, "piano lamp" bulbs and tubular appliance bulbs.

A lamp according to example embodiments of the invention includes an enclosure with an electrical connection. The enclosure may be a tubular enclosure. An array of LED devices is placed in the enclosure and disposed to be operable to emit light when energized through the electrical connection. The array of LED devices may be a linear array. The enclosure is filled with an optically transmissive, fluid medium, which is in thermal communication with the linear array of LED devices. In at least some embodiments, the linear array of LED devices emits light in an omnidirectional pattern. This omnidirectional pattern can be achieved in any number of ways, including geometric placement of the devices in the array, the use of multiple strips of devices, or the use of LEDs with an optically transmissive substrate that allows light to radiate in all directions from the light-emitting layers of the LED. Such a substrate could be, for example, sapphire or silicon carbide.

In some embodiments, the optically transmissive fluid medium is a liquid. In some embodiments, the optically transmissive fluid medium is a gel. An index matching medium can be used as the optically transmissive fluid medium. The index matching medium can have the same refractive index as the material of the enclosure, the LED device package material or the LED substrate material. The index matching medium can have a refractive index that is arithmetically in between the indices of two of these materials. In some embodiments, the optically transmissive, fluid medium contained in the enclosure mechanically supports the array of LED devices while in thermal communication with the array of LED devices. This mechanical support allows the LEDs in the array to be connected together with little or no packaging to further enable an omnidirectional light pattern.

In some embodiments, a finished lamp suitable for use as a replacement for a fluorescent or incandescent bulb includes a power supply coupled to or connected to the linear array of LED devices to energize the devices as appropriate. A color mixing treatment can optionally be included to eliminate color tints in cases where multiple LEDs of different colors are used to produce light. Color treatments can include texturing of the tube or other parts of the lamp assembly, as well as the use of an open cell foam or a nanowire or nanowires permeated with the fluid medium. Production of white light in the omnidirectional pattern can also be achieved by using LEDs that give of light of a specific wavelength of light to energize a phosphor that coats the enclosure or is placed elsewhere within a lamp.

DETAILED DESCRIPTION

The following detailed description refers to the accompanying drawings, which illustrate specific embodiments of the invention. Other embodiments having different structures and operation do not depart from the scope of the present invention.

Embodiments of the invention are described with reference to drawings included herewith. Like reference numbers refer to like structures throughout. It should be noted that the drawings are schematic in nature. Not all parts are always shown to scale. The drawings illustrate but a few specific embodiments of the invention.

Figure 1:
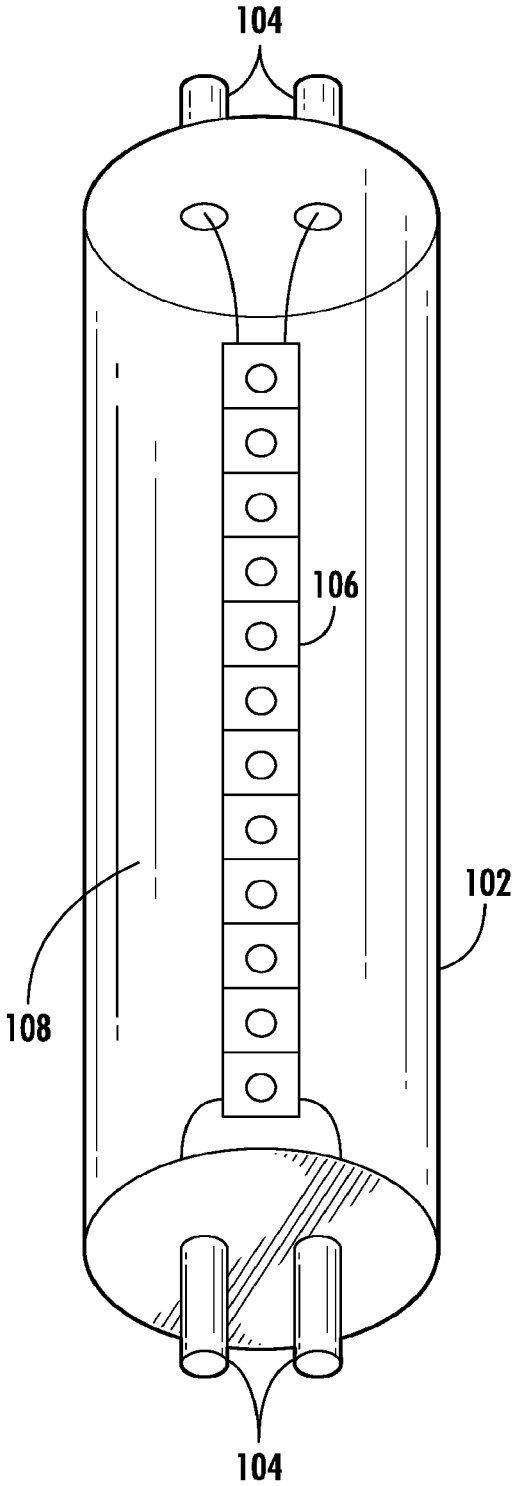
FIG. 1 is a schematic illustration of a linear LED lamp according to example embodiments of the present invention.

FIG. 1 is a diagram of a linear LED lamp according to example embodiments of the invention. Lamp 100 of FIG. 1 includes tubular enclosure 102 with electrical connections 104. The tubular enclosure may be made of glass, plastic, or another suitable material. Within the lamp is a linear array of LED devices 106, which is energized through electrical connections 104. The linear array of LED devices can be a plurality of individual LED chips simply connected together by conductive glue, solder or welds. Different color LEDs can be mixed together to create white light. Alternatively, the LED devices can be a plurality of multi-chip devices coupled together by a wire frame structure or in some other manner. The linear array of LED devices emit light in a substantially omnidirectional or 360-degree pattern so that light is given off around the tubular structure roughly perpendicular to the envelope in all directions, in a fashion similar to that of a standard tubular bulb.

Still referring to FIG. 1, tubular enclosure 102 is filled with an optically transmissive fluid medium 108, such as a liquid or a gel, that has good thermal transfer properties and can provide cooling to the LED devices in the linear array. The medium is in thermal communication with the linear array of LED devices, is substantially nonconductive, and is also optionally viscous enough to support the linear array of LED devices so that the LED devices do not need to be encapsulated in electronic packaging as would be typical of LEDs mounted on circuit boards or installed in equipment panels. In at least some embodiments, the medium is an index matching medium that is characterized by a refractive index that provides for efficient light transfer with minimal reflection and refraction from the LEDs through the tubular enclosure.

As an example, if unpackaged LEDs are used, a fluid with a refractive index between that of the LED substrates and the tubular enclosure can be used. LEDs with a transparent substrate can be used so that light passes through the substrate and can be radiated from the light emitting layers of the chips in all directions. If the substrate chosen is silicon carbide, the refractive index of the substrates is approximately 2.6. If glass is used for the tubular enclosure, the glass would typically have a refractive index of approximately 1.5. Thus a fluid with a refractive index of approximately 2.0-2.1 could be used as the index matching medium. LEDs with a sapphire substrate can also be used. Since the substrate in this case would be an insulator, an ohmic contact would need to pass through the substrate of each LED. However, the refractive index of sapphire is approximately 1.7, so that in this case if glass is again used for the tubular enclosure, the fluid medium could have a refractive index of approximately 1.6. If glass lenses are used on the LED devices, the fluid could have an index of approximately 1.5, essentially matching that of both the lenses and the tubular enclosure.

It should be noted that the LEDs used with an embodiment of the invention can be completely unattached to any separate structure, and simply connected together as previously discussed. In such a case, the fluid medium services to cushion and support the linear array of LED devices to prevent damage caused by the lamp being moved about during shipping and installation, or otherwise being subjected to vibration during transport or use. However, a metal wire frame or some other carrier could be also be used. Secondary optics or reflectors may be provided over and around the LEDs to shape the total light output of the linear LED array. Multiple LED arrays, or strips of LEDs can be combined in one lamp. For example, if LEDs with nontransparent substrates are used, multiple arrays with the substrates facing inward and the light emitting layers of the chips facing outward in different directions can be used to achieve the omnidirectional pattern. An array of LED devices can be twisted into a pattern, such as a helix, or two arrays or strips can be arranged as a double helix, the arrays form intersecting helical coils. Many other arrangements are possible.

It should also be recognized that the term "omnidirectional" and the phrase "substantially omnidirectional" are interchangeable for purposes of this disclosure, and neither term is intended to invoke complete or near complete uniformity of a light pattern. Rather, any pattern that avoids a completely dark area that might otherwise be present due to a mechanical mounting structure or a heat sink could be said to be omnidirectional or substantially omnidirectional within the meaning of the terms as used herein. In embodiments of the invention, some variation of light output around a lamp tube as described might be expected due to reduced transmission through a substrate, placement of multiple arrays of LED devices, and the like.

Figure 2:
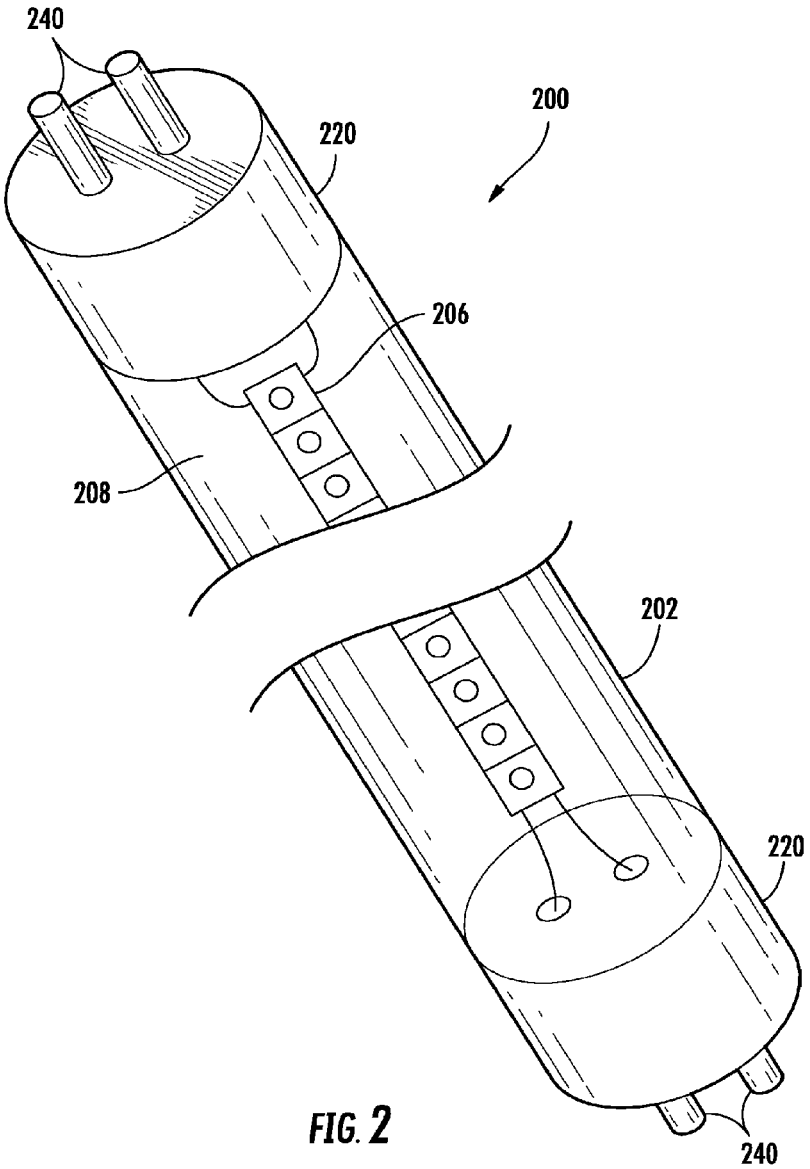
FIG. 2 is a schematic illustration of another linear LED lamp according to example embodiments of the present invention; in this case, the embodiment includes power supply elements to allow the lamp to be powered as part of a pre-existing fixture.

FIG. 2 illustrates another example of a lamp according to example embodiments of the present invention. Lamp 200 of FIG. 2 again includes a tubular enclosure 202. As before, the tubular enclosure can be made of glass, plastic, or any other suitable material. Within this lamp again is a linear array of LED devices 206, which are energized through electrical connections. As before, the linear array of LED devices can be a plurality of individual LED chips simply connected together by conductive glue, solder or welds. Different color LEDs can be mixed together to create white light. Tubular enclosure 202 of lamp 200 is filled with an optically transmissive fluid medium 208, such as a liquid or a gel, that has good thermal transfer properties and can provide cooling to the LED devices in the linear array.

Still referring to FIG. 2, lamp 200 in this case includes an end cap power supply or power supplies 220 coupled to the linear array of LEDs through an electrical connection. Additional connection(s) 240 provide power to the power supplies, which are designed to convert the voltage provided by a light fixture to the voltage needed to supply the linear array of LEDs. In some embodiments, only one of the end caps of the lamp includes an active power supply, which powers to entire string of LEDs, while the other end cap simply allows the external pins to serve as mechanical support. In other embodiments, a power supply is contained in each of the end caps. Each supply in such a case can power a different linear array or different linear arrays of LEDs. For example, each can power an array of approximately half the length of the envelope's length installed end-to-end. Alternatively, if different arrays of the full length of the tube are installed, each power supply could be connected to a different array or arrays of LEDs.

It should be noted that lamp 200 of FIG. 2 could be of various lengths, and that only ends are shown for the sake of clarity and convenience of illustration. Such a lamp can be used as a replacement for a standard fluorescent tube that is commonly found in ceiling fixtures, desk lamps or task lights. In such a case, power supplies 220 would be designed to accommodate the voltage output during startup and operation by such a fixture as originally intended for a fluorescent bulb. Such an embodiment would be directed at retrofitting fixtures that use lamp types T8 or T12, such as those manufactured by G.E., Westinghouse or Sylvania. For example, some such common office ceiling fixtures use four T-12 lamps. The diameter of tubular enclosure 202 and end cap power supplies 220 would also vary according to the bulb to be replaced. As a note, a T12 fluorescent lamp has a 12/8-inch diameter tube, and a T8 fluorescent lamp has an 8/8-inch diameter tube.

In order to more fully explain the various embodiments of the present invention, further details of various possible embodiments will now be discussed. With respect to the fluid medium used, as an example, a liquid, gel, or other material that is either moderate to highly thermally conductive, moderate to highly convective, or both, can be used. As used herein, a "gel" includes a medium having a solid structure and a liquid permeating the solid structure. A gel can include a liquid, which is a fluid. The term "fluid medium" is used herein to refer to gels, liquids, and any other non-gaseous, formable material. The fluid medium surrounds the LED devices in the tubular enclosure. In example embodiments, the fluid medium is nonconductive enough so that no packaging or insulation is needed for the LED devices, although packaging may be included. In example embodiments, the fluid medium has low to moderate thermal expansion, or a thermal expansion that substantially matches that of one or more of the other components of the lamp. The fluid medium in at least some embodiments is also inert and does not readily decompose.

As examples, a fluid medium used in some embodiments may be a perfluorinated polyether (PFPE) liquid, or other fluorinated or halogenated liquid, or gel. An appropriate propylene carbonate liquid or gel having at least some of the above-discussed properties might also be used. Suitable PFPE-based liquids are commercially available, for example, from Solvay Solexis S.p.A of Italy.

As previously discussed, since LEDs typically emit light of a single color or wavelength, it is often desirable to mix multiple LED chips, each emitting a different color of light within a device or within a lamp such as the linear LED lamp of embodiments of the invention. As an example, devices emitting red, green and blue (RGB) light can be used to form substantially white light. As another example, red and blue-shifted yellow (R+BSY) devices might be used together to create substantially white light. If two types of LEDs are used to generate white light, an array of each type of LED can be arranged in the lamp so that the two arrays form the double helix previously discussed.

Since the different color-emitting LED chips in such examples must necessarily be separated in space, even if by very tiny amounts, it may be desirable to add color mixing treatment to the linear lamp in some embodiments to eliminate any color tint that may otherwise appear in parts of the light pattern from the lamp. Color mixing treatment can consist of or include frosting or texturing of the tubular enclosure of the lamp. As additional examples, FIGS. 3 and 4 show embodiments of the lamp in which a color mixing treatment is disposed inside the tubular enclosure of the lamp.

Figure 3:
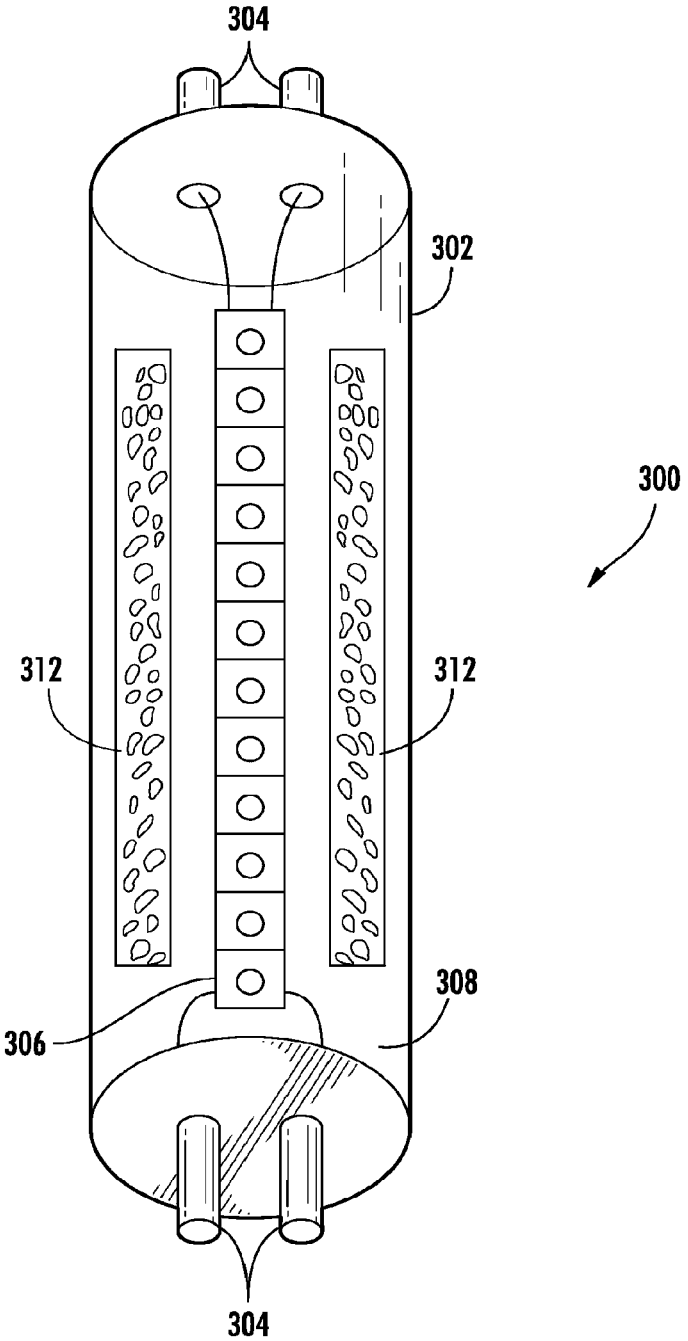
FIG. 3 is a schematic illustration of another linear LED lamp according to example embodiments of the present invention.

FIG. 3 illustrates a lamp 300 using strips of open cell foam as a color mixing treatment. Lamp 300 of FIG. 3 includes tubular enclosure 302 with electrical connections 304. Within the lamp is a linear array of LED devices 306, which are energized through electrical connections 304. Tubular enclosure 302 is filled with an optically transmissive fluid medium 308, such as a liquid or a gel, that has good thermal transfer properties and can provide cooling to the LED devices in the linear array, as previously discussed. Lamp 300 also includes strips of open cell foam, 312. The open cell foam acts as a light diffuser and therefore serves as a color mixing treatment. The fluid medium fills the foam and maintains the thermal properties necessary to cool the LED devices in the linear array. For clarity, only two strips of open cell foam are shown, however, multiple strips may be placed around the LED array, or a continuous tube of open cell foam may be used in the lamp.

Figure 4:
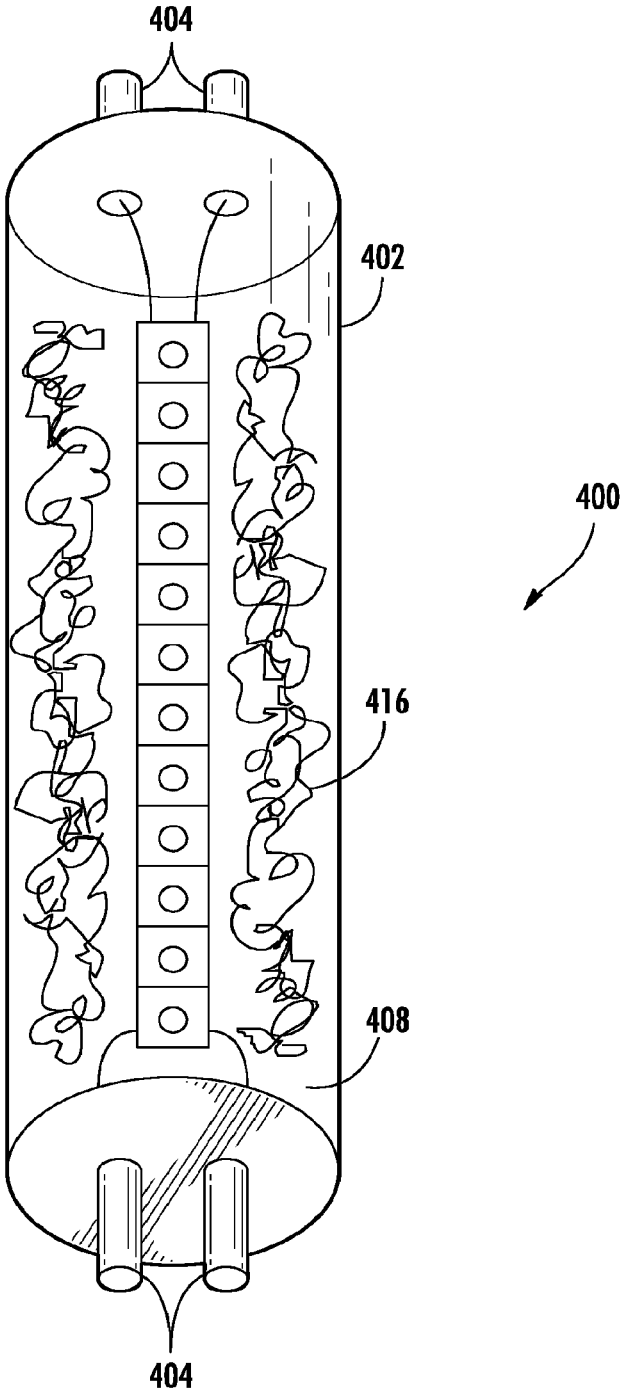
FIG. 4 is a further schematic illustration of yet another linear LED lamp according to example embodiments of the present invention.

FIG. 4 illustrates a lamp 400 using nanowires as a color mixing treatment. Nanowires are very thin wires, which can be hollow. Nanowires as thin as one nanometer have been produced, but nanowires used in typical commercial applications as of this writing are between 30 and 60 nanometers wide. Lamp 400 of FIG. 4 includes tubular enclosure 402 with electrical connections 404. Within the lamp is a linear array of LED devices that are energized through electrical connections 404. Tubular enclosure 402 is filled with an optically transmissive, index matching fluid medium 408, such as a liquid or a gel, that provides cooling to the LED devices in the linear array, as previously discussed. Lamp 400 also includes hollow nanowires 416. The refractive index of the nanowire does not match the fluid medium and so the nanowires act as a light diffuser and therefore serve as a color mixing treatment. The fluid medium fills the nanowires and maintains the thermal properties necessary to cool the LED devices in the linear array. For clarity, nanowires are only shown on two sides of the linear array of LED devices in FIG. 4, however, in a typical embodiment, nanowires would be distributed around the LED array.

It should be noted that as an alternative to producing white light by using LED chips that emit different colors and color mixing treatment, an LED linear lamp according to embodiments of the invention can be designed to use phosphor to emit light. With such a lamp, an array of single-color LED devices would be used, for example, blue, violet, or ultraviolet emitting LED chips. The tubular enclosure of the lamp in this case can be made of glass and the glass can be coated with phosphor that emits substantially white light when energized by the light from the LEDs. It should also be noted that elements of the various embodiments can be combined in ways other than those shown. For example, any or all of the color mixing treatments described above can be used with a lamp that includes power supplies like the lamp shown in FIG. 2.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. Additionally, comparative, quantitative terms such as "less" and "greater", are intended to encompass the concept of equality, thus, "less" can mean not only "less" in the strictest mathematical sense, but also, "less than or equal to."

It should also be pointed out that references may be made throughout this disclosure to figures and descriptions using terms such as "up", "inward", "outward", "down", "side", "top", "in", "within", "on", and other terms which imply a relative position of a structure, portion or view. These terms are used merely for convenience and refer only to the relative position of features as shown from the perspective of the reader. An element that is placed or disposed atop another element in the context of this disclosure can be functionally in the same place in an actual product but be beside or below the other element relative to an observer due to the orientation of a device or equipment. Any discussions which use these terms are meant to encompass various possibilities for orientation and placement.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A lamp comprising:

a tubular enclosure having an electrical connection at an end; and at least one array of LED devices electrically connected without a mechanical support structure and disposed in the tubular enclosure without being encapsulated to enable the lamp to emit light in all directions when the at least one array of LED devices is energized through the electrical connection; and an optically transmissive, fluid medium contained in the enclosure in thermal communication with the at least one array of LED devices.

2. The lamp of claim 1 wherein the at least one array of LED devices is twisted.

3. The lamp of claim 2 wherein the at least one array of LED devices is twisted into one of a helix and a double helix.

4. The lamp of claim 1 wherein the LED devices are mounted on a carrier.

5. The lamp of claim 4 further comprising a color mixing treatment.

6. The lamp of claim 5 wherein the color mixing treatment comprises frosting or texturing on the tubular enclosure.

7. The lamp of claim 5 wherein the at least one array of LED devices further comprises red and blue-shifted yellow LED devices so that the light is substantially white light.

8. The lamp of claim 7 wherein the at least one array of LED devices comprises an array of the red LED devices and an array of the blue-shifted yellow LED devices.

9. The lamp of claim 8 wherein the array of red LED devices and the array of blue-shifted yellow LED devices form a double helix.

10. The lamp of claim 1 wherein the tubular enclosure is coated with phosphor.

11. The lamp of claim 10 further wherein the at least one array of LED devices comprises LED devices, which when energized emit a single color of light.

12. A lamp comprising:

an enclosure having an electrical connection at an end;

a carrier;

a plurality of LED devices disposed in the enclosure, the plurality of LED devices being connected without a mechanical support structure and without being encapsulated as a linear array so that light from the plurality of LED devices is emitted from the lamp in a substantially omnidirectional 360-degree pattern when the plurality of LED devices is energized through the electrical connection; and an optically transmissive, fluid medium contained in the enclosure in thermal communication with the plurality of LED devices.

13. The lamp of claim 12 wherein the carrier is twisted.

14. The lamp of claim 12 further comprising a color mixing treatment.

15. The lamp of claim 14 wherein the color mixing treatment comprises frosting or texturing on the enclosure.

16. The lamp of claim 15 wherein the plurality of LED devices further comprises red and blue-shifted yellow LED devices so that the light is substantially white light.

17. The lamp of claim 16 comprising two carriers wherein the red LED devices are mounted on a first carrier and the blue-shifted yellow LED devices are mounted on a second carrier.

18. The lamp of claim 17 wherein the first carrier and the second carrier are twisted.

19. The lamp of claim 12 further comprising a phosphor on the enclosure.

20. The lamp of claim 19 further wherein the plurality of LED devices emits a single color of light.

* * * * *